US005992482A

United States Patent [19]

Voisey

[11] Patent Number: 5,992,482

[45] Date of Patent: Nov. 30, 1999

[54] TOOL REST

[76] Inventor: Nigel Stuart Voisey, 44 Heol Powis, Birchgrove, Cardiff CF4PH, United Kingdom

[21] Appl. No.: 08/889,004

[22] Filed: Jul. 7, 1997

[30] Foreign Application Priority Data

Jul. 9, 1996 [GB] United Kingdom ..... 9614390

[51] Int. Cl.[6] ..... B27C 7/06

[52] U.S. Cl. ..... 142/49; 142/1

[58] Field of Search ..... 142/1, 48, 49; 82/158

[56] References Cited

U.S. PATENT DOCUMENTS

| | | | |
|---|---|---|---|
| 1,240,474 | 9/1917 | Moore et al. | 142/49 |
| 2,697,456 | 12/1954 | Goldschmidt | 82/158 |
| 4,133,357 | 1/1979 | Groya et al. | 142/49 |
| 4,502,517 | 3/1985 | Larson | 142/49 |
| 5,186,088 | 2/1993 | Wixey | 82/142 |

OTHER PUBLICATIONS

Sainsbury, John. John Sainsbury's Guide to Woodturning Tools and Equipment (New York: Sterling Publishing, 1989), pp. 96, 97, 99.

*Primary Examiner*—Steven C. Bishop
*Attorney, Agent, or Firm*—Edwin D. Schindler

[57] ABSTRACT

A tool rest, for attaching to a lathe or wood turning apparatus, in which a pillar for is mounted rotatable about a first vertical axis and has a first horizontally-projecting arm and further has a second horizontally-projecting portion rotatable about a second vertical axis which may be coincident with or spaced horizontally from the first vertical axis. In use, the tip of a cutting tool is rested on the horizontal arm the tool is also rested on the second horizontal portion where it is firmly held in place by the user.

14 Claims, 1 Drawing Sheet

TOOL REST

FIELD OF THE INVENTION

The present invention relates to a device for supporting a tool relative to a lathe or wood-turning apparatus.

BACKGROUND OF THE INVENTION

Conventional tool-rests, for use with lathes or other wood turning apparatus, typically comprise a pillar having a single horizontally projecting arm for supporting a cutting tool. The projecting arm provides a fulcrum for the shaft of the cutting tool whose forward end is held in place by the turner's leading hand, the cutting force being prevented from snatching the tool-tip downwards by means of a counter-leverage applied to the handle of the tool gripped by the turner's other hand.

It is essential that support is provided as close as possible to the surface of the work-piece so that the shaft of the cutting tool is not subjected to an excessive torque and so that optimum control over the tool tip is maintained. Therefore, when performing a bowl hollowing operation, the pillar is preferably rotatable about a vertical axis through its centre to allow the support arm (which may be arcuate in form) to project into the concave interior of the bowl being formed.

However, a significant drawback of such a tool-rest is that, in order to hold a tool in place whilst forming the interior of a bowl, the turner is forced to place his leading hand inside the rotating bowl, an obvious safety hazard.

It is an object of the present invention to provide a tool-rest which overcomes the above-mentioned drawback of existing support arrangements.

SUMMARY OF THE INVENTION

In accordance with the present invention, there is provided a tool-rest for attaching to a lathe or wood-turning apparatus, said tool-rest comprising a pillar, for mounting rotatably about a first vertical axis and having a first horizontally projecting portion and a second horizontally projecting portion rotatable about a second vertical axis.

Thus, a cutting tool may have its forward end rested upon said first projecting portion, which may project into the interior of a bowl, whilst the tool is held in place by gripping or levering against said second projecting portion, arranged to lie some distance from the surface of the work-piece.

The second vertical axis, about which the second horizontally projecting portion can be turned, may be coincident with the first vertical axis, about which the pillar can be turned. Preferably however, the first and second vertical axes are spaced from one another.

Preferably said tool-rest comprises a clamp for fixing the relative positions of said first and said second horizontally projecting portions.

Preferably said first horizontally projecting portion comprises an arcuate arm, of the type commonly used for bowl cutting operations.

Preferably said second horizontally projecting portion comprises an extensible bar.

Preferably said first and said second horizontally projecting portions are provided with means for attaching additional supports, fulcrums or bracing pieces.

Preferably the height of said first and/or of said second projecting portion may be varied.

BRIEF DESCRIPTION OF THE DRAWINGS

An embodiment of the present invention will now be described by way of example only and with reference to the accompanying drawings, in which.

DETAILED DESCRIPTION OF THE DRAWINGS

Figure 1:
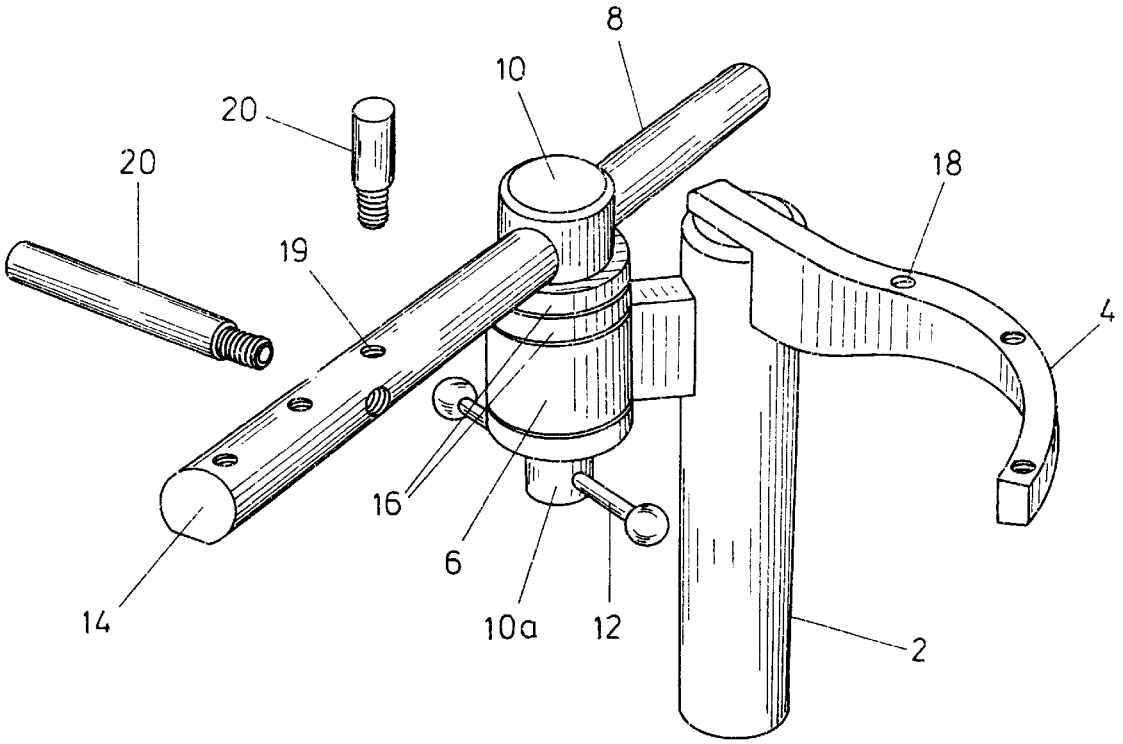
FIG. 1 is a perspective view of a tool-rest in accordance with the present invention.

Referring to the drawings, a tool-rest is shown comprising a rotatably-mounted pillar 2 having an arcuate arm 4 extending horizontally from its top, and a bracket 6 supporting an elongate bar 8. Two parts 10, 10*a* of a clamping arrangement are screw-threaded together and extend through a vertical bore in the bracket 6. The bar 8, which has a flat on its lower side, extends through a complementary-section hole in the upwardly-projecting end of part 10 of the clamping arrangement. A handle 12 extends through a hole in the lower end of the part 10*a* of the clamping arrangement. It will be appreciated that, by means of a handle 12, the clamping arrangement may be loosened, to allow the bar 8 to be turned about a vertical axis and slid longitudinally to vary the length of projecting bar-end 14, or tightened to fix the selected position of the bar 8 relative to the bracket 6.

One or more spacers 16 may be fitted to the top of the bracket 6 under the top portion of the top part 10 of the clamping arrangement, as shown, to vary the height of the elongate bar 8 relative to the arcuate arm 4.

Both the arcuate arm 4 and the elongate bar 8 are formed with threaded bores e.g. 18,19 for attaching additional devices, such as the posts 20 illustrated, to provide further support, fulcrum or bracing means.

Figure 2:
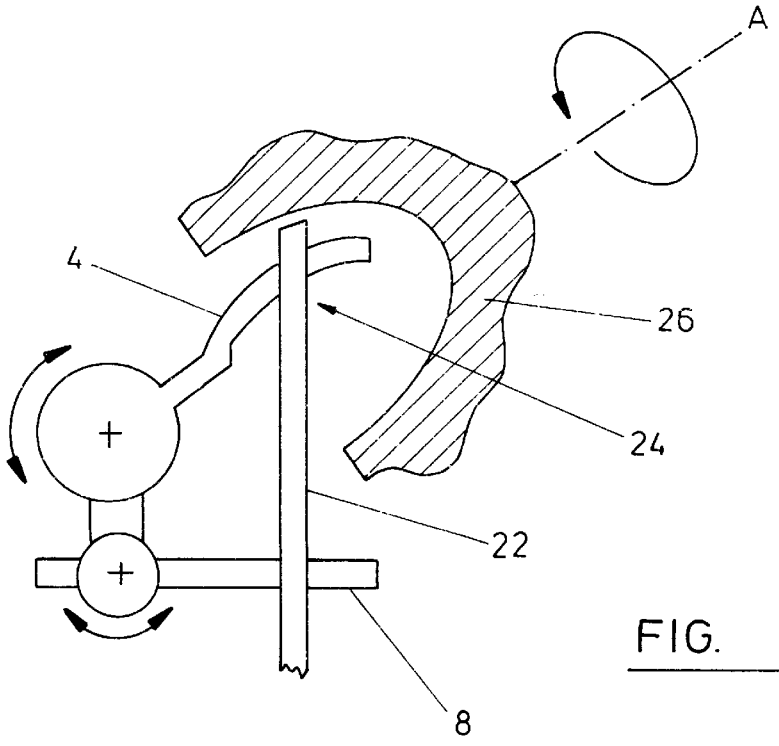
FIG. 2 is a plan view illustrating the tool-rest arranged to perform a bowl cutting operation.

FIG. 2 illustrates schematically how the tool-rest may be arranged to provide support for a cutting tool 22, used to form a concave feature 24 in a workpiece 26 as it is turned, in the direction indicated, about an axis A.

The tip of the cutting tool 22 rests upon the arcuate arm 4 which projects into the concave region 24 so as to lie adjacent the surface of the workpiece 26. The tool 22 also rests upon the elongate bar 8 where it may be firmly held in place by the turner. Thus, according to the present invention, the turner is no longer required to insert one of his hands into the concave region 24.

The tool-rest thus described provides a safe and effective support means which allows precise and positive control of a cutting tool whilst reducing operator fatigue.

I claim:

1. A tool rest for a lathe or a wood turning apparatus, said tool rest comprising:

a vertical pillar for mounting rotatably about a first vertical axis;

a first arm projecting horizontally from said vertical pillar adjacent a top end thereof and serving as a main rest for supporting a forward end of a cutting tool;

mounting means mounted to said vertical pillar adjacent its said top end for rotation around a second vertical axis; and, a second arm mounted to said mounting means and projecting horizontally from said mounting means for forming an auxiliary rest for supporting said cutting tool at a point thereof rearwardly of its said forward end.

2. The tool rest according to claim 1, wherein said second vertical axis is spaced horizontally from said first vertical axis.

3. The tool rest according to claim 1, further comprising clamping means for clamping said mounting means in a selected angular position about said second vertical axis.

4. The tool rest according to claim 1, wherein said first arm comprises an inner end portion mounted to said vertical pillar and a main portion extending in an arcuate manner from said inner end portion.

5. The tool rest according to claim 1, wherein said second arm comprises an elongate bar which is adjustable longitudinally of itself, relative to said mounting means.

6. The tool rest according to claim 5, further comprising clamping means for clamping said elongate bar in a selected longitudinal position relative to said mounting means.

7. The tool rest according to claim 1, wherein, at least, one of said first arm and said second arm is provided with means for attaching thereto support means.

8. The tool rest according to claim 1, wherein, at least, one of said first arm and said second arm is provided with means for attaching thereto fulcrum means.

9. The tool rest according to claim 1, wherein, at least, one of said first arm and said second arm is provided with means for attaching thereto bracing means.

10. The tool rest according to claim 1, further comprising means for adjusting said second arm relative to said first arm when said second arm is vertically positioned.

11. A tool rest for a lathe or a wood turning apparatus, said tool rest comprising:

a vertical pillar for mounting rotatably about a first vertical axis;

a first arm projecting horizontally from said vertical pillar adjacent a top end thereof and serving as a main rest for supporting a forward end of a cutting tool, said first arm comprising an inner end portion mounted to said vertical pillar and a main portion extending in an arcuate manner from said inner end portion;

mounting means mounted to said vertical pillar adjacent its said top end for rotation around a second vertical axis; and, a second arm mounted to said mounting means and projecting horizontally from said mounting means for forming an auxiliary rest for supporting said cutting tool at a point thereof rearwardly of its said forward end, said second arm comprising an elongate bar being adjustable, longitudinally of itself, relative to said mounting means.

12. The tool rest according to claim 11, further comprising clamping means for clamping said mounting means in a selected angular position about said second vertical axis and for clamping said elongate bar in a selected longitudinal position relative to said mounting means.

13. The tool rest according to claim 12, further comprising a bracket mounted to said vertical pillar adjacent said top end thereof and being provided with a vertical bore, said mounting means comprising a member rotatably engaged within said vertical bore and having a top end portion projecting upwardly out of said vertical bore, said top end portion being formed with a transverse hole through which said elongate bar extends, and said clamping means comprising a member screw-threadedly engaged with said member of said mounting means, for clamping said elongate bar against a top portion of said bracket.

14. A lathe or a wood turning apparatus fitted with a tool rest, said tool rest comprising:

a vertical pillar for mounting rotatably about a first vertical axis;

a first arm projecting horizontally from said vertical pillar adjacent a top end thereof and serving as a main rest for supporting a forward end of a cutting tool;

mounting means mounted to said vertical pillar adjacent its said top end for rotation around a second vertical axis; and, a second arm mounted to said mounting means and projecting horizontally from said mounting means for forming an auxiliary rest for supporting said cutting tool at a point thereof rearwardly of its said forward end.

* * * * *